United States Patent [19]

Usui

[11] Patent Number: 5,024,198

[45] Date of Patent: Jun. 18, 1991

[54] FUEL DELIVERY RAIL ASSEMBLY

[75] Inventor: Masayoshi Usui, Numazu, Japan

[73] Assignee: Usui Kokusai Sangyo Kaisha Ltd., Shizuoka, Japan

[21] Appl. No.: 531,684

[22] Filed: Jun. 1, 1990

[30] Foreign Application Priority Data

Jun. 6, 1989 [JP] Japan ..... 1-65436[U]

[51] Int. Cl.[5] ..... F02M 55/02

[52] U.S. Cl. ..... 123/468; 123/470; 138/163; 138/141; 239/550

[58] Field of Search ..... 123/468, 469, 470, 472, 123/456; 138/26, 27, 28, 30, 163, 156, 169, 140, 141, 149; 239/550, 551, 600

[56] References Cited

U.S. PATENT DOCUMENTS

| | | | |
|---|---|---|---|
| 686,419 | 11/1901 | Page | 138/163 |
| 686,817 | 11/1901 | MacPhail | 138/163 |
| 3,877,490 | 4/1975 | Tsubouchi | 138/141 |
| 4,457,280 | 7/1984 | Hudson | 123/468 |
| 4,474,160 | 10/1984 | Gartner | 123/468 |
| 4,519,368 | 5/1985 | Hudson | 123/468 |
| 4,600,615 | 7/1986 | Hyodo | 138/141 |
| 4,649,884 | 3/1987 | Tuckey | 123/470 |
| 4,660,524 | 4/1987 | Bertsch | 123/468 |
| 4,899,712 | 2/1990 | De Bruyn | 123/468 |
| 4,922,958 | 5/1990 | Lemp . | |
| 4,971,014 | 11/1990 | Usui | 123/470 |

FOREIGN PATENT DOCUMENTS 59-107050 7/1984 Japan .

*Primary Examiner*—Carl Stuart Miller

*Attorney, Agent, or Firm*—Wenderoth, Lind & Ponack

[57] ABSTRACT

A fuel delivery rail assembly for supplying fuel to a plurality of fuel injectors in an engine is provided. The assembly comprises an elongated conduit and a plurality of sockets. The conduit has a four-wall section consisting of a single aluminum wall and three steel walls. Opposing steel walls are provided with cavities for receiving edges of the aluminum wall. Abutment portions between the aluminum wall and the steel walls are mechanically shrinked from outside and combined tightly. The sockets are integrally formed with the aluminum wall through an aluminum die casting process. The steel walls can be made from a high damping steel element.

2 Claims, 2 Drawing Sheets

FUEL DELIVERY RAIL ASSEMBLY

BACKGROUND OF THE INVENTION

This invention relates to a fuel delivery rail assembly for an internal combustion engine, especially for an automotive engine, equipped with a fuel injection system. The fuel delivery rail assembly delivers pressurized fuel supplied from a fuel pump toward intake passages or chambers via associated fuel injectors. The assembly is used to simplify installation of the fuel injectors and the fuel supply passages on the engine.

An example of a fuel delivery rail assembly having a rectangular section is shown in FIG. 5 of the drawings. In this assembly, an elongated conduct 71 is formed by a steel tube having a rectangular hollow section. To an end of the conduit 71, a fuel inlet pipe 77 for introducing gasoline fuel is secured, and to the other end of the conduit 71, a fuel return pipe 78 leading to an exit for residual fuel is secured, both pipes being welded to the conduit 71 by copper brazing. To the insides of the conduit 71 and the pipes 77, 78, a copper plating is coated for protecting the surfaces from rust and for keeping the fuel clean. At the intermediate portion of the conduit 71, four tubular sockets 74 are inserted into guide holes arranged within the bottom wall of the conduit 71 at predetermined intervals, and welded thereto by copper brazing. These sockets 74 are so formed as to receive associated tips of fuel injectors. The axial directions of the sockets should precisely line up in alignment with the respective axial direction of the injectors. Furthermore, pitch lengths between adjacent sockets should precisely coincide with the corresponding pitch lengths between associated injectors. One of the objects of the present invention is directed to these alignment problems as discussed in detail below.

On the aforementioned copper plating portions, a further coating is needed for preventing copper ion from dissolving in the fuel. Therefore, after the copper brazing and coating, a chemical plating (non-electrolytic plating) is applied to the all surfaces by coating thin metallic layers such as Ni-P or Sn. However, since the assembly is formed in a box shape, it takes a considerable time to let the plating liquid flow into the conduit and then drain away the conduit perfectly. Furthermore, a rotating action and an up and down action of the conduit are needed for draining residual air and liquid during the plating steps. Even if these actions are performed, it is difficult to eliminate plating defects caused by the remaining air and liquid. As a result, undesirable rust is generated from the plating defects. After the treatment, the residual plating liquid staying at the inside of the box-shape conduit is carried back to a container for renewal, whereby a liquid degradation and consumption are accelerated, resulting in an increase of plating liquid supply or recirculation steps.

Referring to the sockets 74, especially interior surfaces thereof should be smoothly finished in order to establish a fluid tight seal of an O-ring after accommodating the respective fuel injector. In manufacturing process of the metallic socket 74, many kinds of working steps are needed. For example, at first a rough fabrication is made by a forging work, and then it is machined to make a form, of the interior surface. Finally, the socket is finished with a burnishing machine until the predetermined smoothness is obtained. For making the socket 74, abovementioned many kinds of time-consuming working steps and transferring handlings are needed, resulting in an increase of manufacturing cost.

Furthermore, it has been found that this kind of fuel delivery rail assembly generates a special noise due to a vibration of itself caused by the associated engine.

In Japanese utility model public disclosure No. 107050/1984, there is disclosed a combined type fuel delivery rail assembly which comprises a conduit made from extruded aluminum material, and sockets and brackets made from other materials. However, the connected portion between the conduit and the socket tends to be separated therefrom, thereby causing a fuel leakage or breakdown.

SUMMARY OF THE INVENTION

It is an object of the present invention to overcome the above disadvantages in producing the fuel delivery rail assembly and to reduce the number of working steps.

Another object of the present invention is to improve alignment problems in mounting of the fuel delivery rail assembly to an engine.

A further object of the present invention is to improve the plating treatment of the conduit and to eliminate a generation of rust for obtaining high quality assembly.

Still further object of the present invention is to damp a gneration of noise caused by a vibration of the fuel delivery rail assembly.

According to the invention, there is provided a fuel delivery rail assembly for an internal combustion engine comprising; an elongated conduit having a fuel inlet at an end and a fuel exit at the other end, and a plurality of sockets so formed as to receive fuel injectors, the section of said conduit being formed in a hollow shape having four walls, one of said walls being made from aluminum die casting, and the other walls being integrally formed by steel materials, opposing edges of said steel walls being provided with cavities for receiving respective edges of said aluminum wall, abutment portions between said aluminum wall and said steel walls being mechanically shrinked from outside thereby being tightly combined, each of said sockets being integrally formed with said aluminum wall.

Within the scope of the invention, the section of the conduit is composed of an aluminum die casting wall and intergral steel walls. The aluminum wall is made through a high pressure casting process in which melted aluminum alloy is charged into a metallic die. Since all the sockets are formed with the aluminum wall, they are precisely arranged in positions to be registered with the positions of the associated fuel injectors.

The aluminum sockets can be made together with the wall to meet a required shape and surface smoothness through a die casting process utilizing a metallic die. Thus, a smooth inside surface suitable for receiving a tip of a fuel injector can be accomplished easily. There is no need of complicated forging, machining, provisional spot welding, brazing and correction steps which are needed in manufacturing of the conventional metallic socket.

While the steel portions of the conduit are plated and coated, they are separated from the aluminum portion, whereby one side of the conduit is kept in open. Residual air or liquid is not existing within the open conduit. Thus, the plating step can be easily performed and plating liquid can be saved. With a good selection of conditions, electrolytic plating may be applied in the plating step so as to reduce time and cost for manufacturing.

In a preferable embodiment of the invention, the steel walls of the conduit can be made from high damping steel elements including united steel plates and sandwiched thermoplastic visco-elasticity high polymer. The thickness of the high polymer can be selected in a range of 0.05 to 0.2 mm. The high polymer and the steel plates are integrally combined by an adhesive or similar agent. By use of the high damping steel elements, the noise generated from the fuel delivery rail assembly can be effectively reduced.

Other features and advantages of the invention will become apparent from a reading of the specification, when taken in conjunction with the drawings, in which, like reference numerals refer to like elements in the several views.

BRIEF DESCIPTION OF THE DRAWINGS

DESCRIPTION OF THE PREFERRED EMBODIMENT

Figure 1:
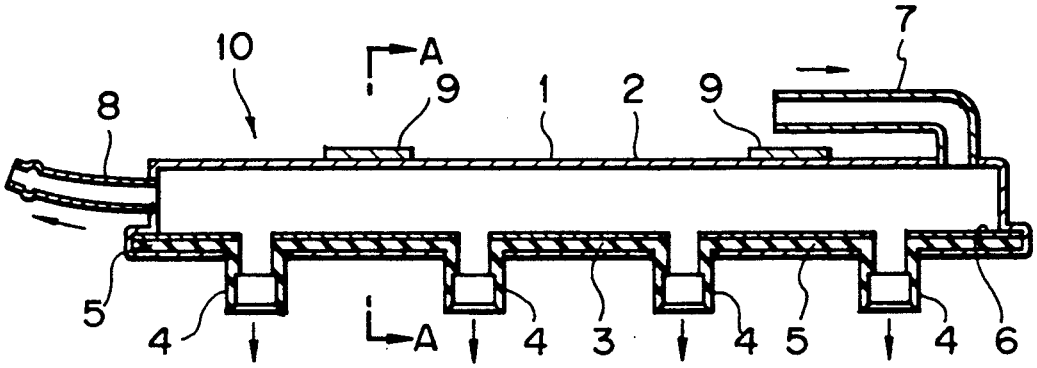
FIG. 1 is a vertical sectional view of the fuel delivery rail assembly according to the invention.
Figure 5:
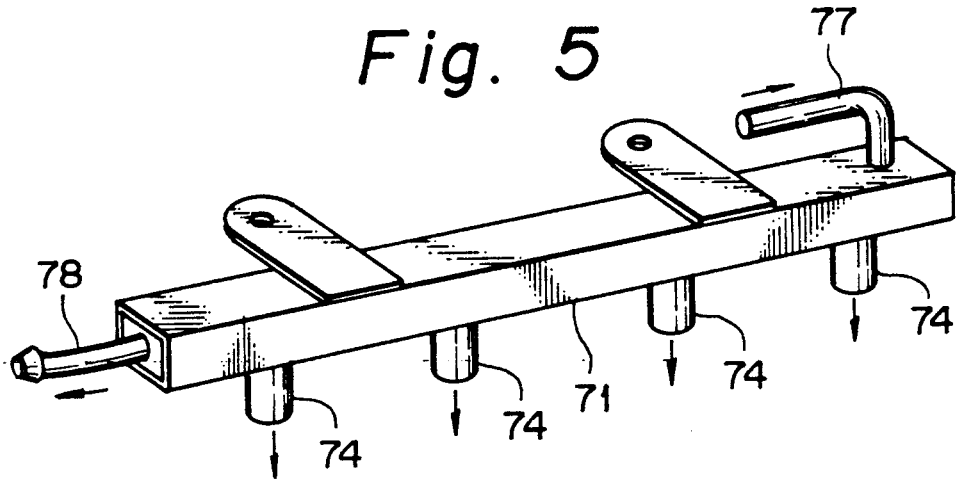
FIG. 5 is a pespective view illustrating a fuel delivery rail assembly.

Referring to FIG. 1, there is shown a fuel delivery rail assembly 10, a first embodiment of the present invention, which is adapted to four cylinders on one side of an automotive V-8 engine. Perspective view of the assembly 10 is similar to FIG. 5. This assembly 10 comprises an elongated conduit 1 having a fuel inlet at an end and a fuel exit at the other end, and four sockets 4 attached to the bottom side of the conduit 1. The sockets 4 are disposed along the longitudinal direction of the conduit 1 at predetermined intervals so as to be registered with the positions of fuel injectors.

Figure 2:
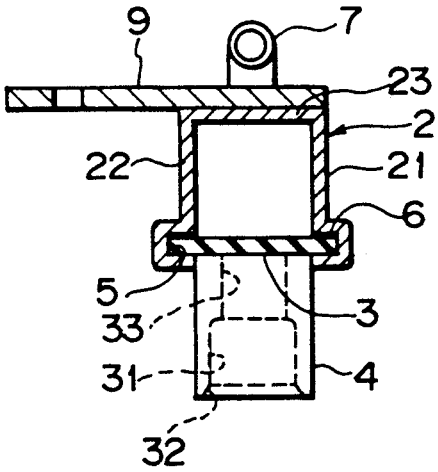
FIG. 2 is a vertical sectional view taken along the line A—A in FIG. 1.

As shown in the sectional view of FIG. 2, the section of the conduit 1 is formed into an essentially rectangular hollow shape having four walls, providing a fuel passage. Side walls 21 and 22, and an upper wall 23 are integrally formed into a channel member 2, which can be produced by a process of steel plate roll forming or press working.

The flat bottom wall 3 is made from aluminum alloy die casting integrally with the sockets 4, which are extending downward from the bottom surface of the wall 3. Opposing edges of the side walls 21 and 22 are bent outwardly and inwardly so as to form a cavity 5 within each edge. Inside of each cavity 5, a side edge of the flat wall 3 is inserted together with a seal member 6, and then abutment portions between the flat wall 3 and the steel walls 21, 22 are mechanically shrinked from outside by means of caulking tools, thereby being tightly combined.

As shown in FIG. 1, the cavity 5 is also disposed at the distal ends of the elongated conduit 1 in order to establish a complete sealing around the periphery of the flat wall 3. Thus, the retangular conduit 1 is composed of a folded steel plate and aluminum alloy die casting.

To an end of the conduit 1, an inlet pipe 7 is fixed by brazing so as to connect with a pressure regulator or any other part leading to a fuel pressurizing pump, and to another end of the conduit 1, a return pipe 8 is fixed by brazing so as to receive a rubber hose for passing residual fuel to another fuel delivery rail assembly on the other side of the V-8 engine. Residual fuel is finally carried back to a fuel tank. To the upper side of the conduit 1, rigid brackets 9 are fixed so as to mount the assembly 10 on the engine.

Inside of the aluminum alloy socket 4, are provided smooth interior surface 31 for receiving a body of an injector having an O-ring thereon, a conical cut end surface 32 at the top opening, and a stepped bottom opening surface 33.

The sockets 4 and the flat wall 3 are integrally made from aluminum alloy such as standardized materials A1ADC 10 or A1ADC 12, which are defined by Janpanese Industrial Standard, through a die casting process utilizing a metallic die. Thus, the interior surfaces are finished to obtain a required surface smoothness.

Plating treatment is applied to a sub-assembly comprising the steel walls 21, 22, 23, the fuel inlet pipe 7, the fuel return pipe 8 and the brackets 9. This sub-assembly is not a box-shape, so that the plating is easily performed without causing plating defects.

In the final assembly, the flat wall 3 is fixed within the cavity 5 disposed in the steel walls. Even if thermal expansion is caused, the flat wall 3 is held at the original position. Accordingly, sealing performance in the abutment portions is effectively maintained. The seal member 6 can be selected from various elements depending upon the sealing conditions. It is also possible to omit the seal member 6, as long as sealing performance is maintain without it.

Figure 3:
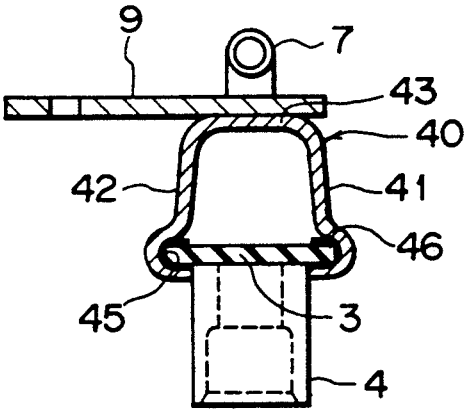
FIG. 3 is a vertical sectional view similar to FIG. 2 of another embodiment of the invention.

FIG. 3 shows another embodiment of the invention. The section of the conduit 40 is formed in a round four-wall configuration. Side walls 41 and 42, and the upper wall 43 are integrally formed by a steel plate. The bottom wall 3 is made from aluminum die casting. Opposing edges of the side walls 41 and 42 are bent outwardly and inwardly so as to form a round cavity 45 within each edge. Inside of each cavity 45, a side edge of the flat wall 3 is inserted together with a U-shape seal member 46, and then abutment portions between the flat wall 3 and the steel walls 41, 42 are mechanically shrinked from outside by means of caulking tools, thereby being tightly combined.

Figure 4:
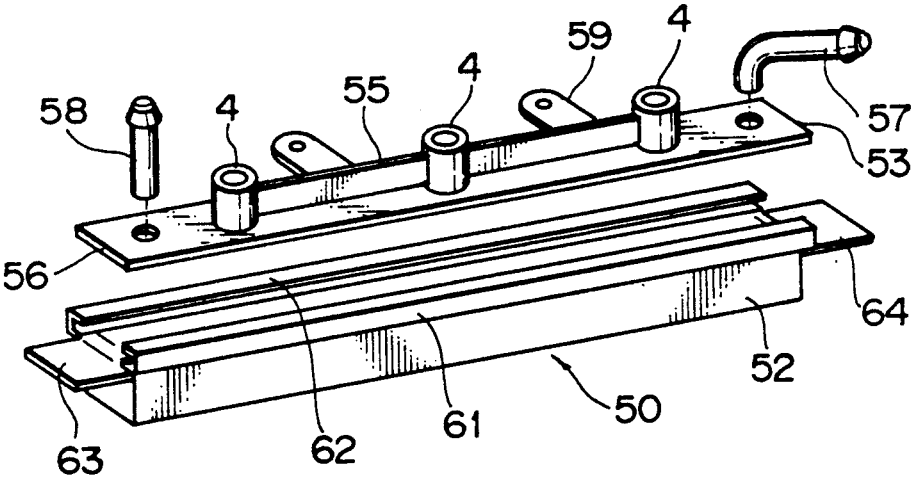
FIG. 4 is an exploded perspective view illustrating a further embodiment of the invention.

FIG. 4 shows a further embodiment of the invention. The four-wall configuration of the conduit 50 is defined by a box-shape steel plate 52 and an aluminum alloy die casting plate 53. Sockets 4 are integrally formed with the aluminum alloy wall 53 accompanying with connecting ribs 55 and mounting brackets 59. The aluminum plate 53 is provided with two guide holes for receiving the inlet pipe 57 and the return pipe 58. These pipes 57 and 58 are inserted into the guide holes and brazed to the plate 53.

The box-shape steel plate 52 is made from a high damping steel element consisting of two steel plates and sandwiched thermoplastic visco-elasticity high polymer.

During an assembling process of the conduit 50, at first the aluminum plate 53 accompanying with a seal member 56 is inserted into a space between the opposing edges 61 and 62 of the conduit 50. Then, the edges 61, 62 and extended side tabs 63, 64 are folded and mechanically shrinked from outside by caulking tools. Thus, the conduit 50 completed.

Since the box-shape steel plate 52 is made from a high damping steel element, the conduit 50 can render a vibration damping effect.

Thus, as is apparent from the above discription, the fuel delivery rail assembly of the present invention can provided technical advantages as follows:

(a) Since many kinds of working and transferring steps can be saved, manufacturing process is considerably simplified.

(b) Since the sockets are integrally formed with the wall, the sockets are precisely arranged in their predetermined positions.

(c) Since the plating treatment is applied to the subassembly, the quality of plating and coating is improved and a generation of rust is eliminated.

(d) Since the high damping steel element can help to damp a vibration of the assembly, a generation of noise is reduced.

I claim:

1. A fuel delivery rail assembly for an internal combustion engine comprising;

an elongated conduit having a fuel inlet at an end and a fuel exit at the other end, and a plurality of sockets so formed as to receive fuel injectors, the section of said conduit being formed in a hollow shape having four walls, one of said walls being made from aluminum die casting, and the other walls being integrally formed by steel materials, opposing edges of said steel walls being provided with cavities for receiving respective edges of said aluminum wall, abutment portions between said aluminum wall and said steel walls being mechanically shrinked from outside thereby being tightly combined, each of said sockets being integrally formed with said aluminum wall.

2. A fuel delivery rail assembly as claimed in claim 1, wherein said steel walls of the conduit comprise a high damping steel element consisting of two steel plates and sandwiched thermoplastic visco-elasticity high polymer.

* * * * *